US010328331B2

(12) United States Patent
Hitch

(10) Patent No.: US 10,328,331 B2
(45) Date of Patent: Jun. 25, 2019

(54) MECHANICAL TRACTION FOR A CROSS-COUNTRY SKI

(71) Applicant: Douglas A. Hitch, Whitehorse (CA)

(72) Inventor: Douglas A. Hitch, Whitehorse (CA)

( * ) Notice: Subject to any disclaimer, the term of this patent is extended or adjusted under 35 U.S.C. 154(b) by 15 days.

(21) Appl. No.: 15/575,564

(22) PCT Filed: Jun. 13, 2016

(86) PCT No.: PCT/CA2016/050673

§ 371 (c)(1),
(2) Date: Nov. 20, 2017

(87) PCT Pub. No.: WO2016/197256

PCT Pub. Date: Dec. 15, 2016

(65) Prior Publication Data

US 2018/0133584 A1 May 17, 2018

Related U.S. Application Data

(60) Provisional application No. 62/175,144, filed on Jun. 12, 2015.

(51) Int. Cl.
*A63C 7/00* (2006.01)
*A63C 7/10* (2006.01)
(Continued)

(52) U.S. Cl.
CPC ..... *A63C 7/005* (2013.01); *A63C 5/044* (2013.01); *A63C 7/102* (2013.01); *A63C 7/1046* (2013.01);
(Continued)

(58) Field of Classification Search
CPC ..... A63C 7/005
See application file for complete search history.

(56) References Cited

U.S. PATENT DOCUMENTS 3,703,013 A * 11/1972 Leach ..... B63B 35/812 441/70
4,148,500 A 4/1979 Nidecker
(Continued)

FOREIGN PATENT DOCUMENTS

EP 0724897 8/1996
SE 42996 5/1914
(Continued)

*Primary Examiner* — James A Shriver, II
*Assistant Examiner* — James J Triggs
(74) *Attorney, Agent, or Firm* — Nexus Law Group LLP; Nicholas P. Toth

(57) ABSTRACT

A snow ski has a longitudinal body defining a sole for gliding on the snow. The ski includes: (a) a platform slidably coupled to the body for sliding longitudinally relative to the body; and (b) a gripping element slidably and rotatably coupled to the body and rotatably coupled to the platform. The gripping element extends downward to penetrate the snow in response to the platform being slid rearward relative to the body. The gripping element retracts upward above the sole when the platform is slid forward relative to the body. First and second gripping elements may be disposed on opposing sides of the body. A locking mechanism selectively locks the platform at a forward position, in which the gripping element is retracted, one or more intermediate positions, or a rearward position in which the gripping element extends to penetrate the snow.
A ski-traction kit for retrofitting a ski is provided.

15 Claims, 5 Drawing Sheets

(51) Int. Cl.

| | |
|---|---|
| ***A63C 7/12*** | (2006.01) |
| ***A63C 5/044*** | (2006.01) |
| ***A63C 9/08*** | (2012.01) |
| ***A63C 9/086*** | (2012.01) |

(52) U.S. Cl.
CPC ..... *A63C 7/1086* (2013.01); *A63C 7/12* (2013.01); *A63C 9/086* (2013.01); *A63C 9/0807* (2013.01)

(56) References Cited

U.S. PATENT DOCUMENTS

| | | | | | |
|---|---|---|---|---|---|
| 4,564,210 | A | | 1/1986 | Case | |
| 4,642,060 | A | * | 2/1987 | Scheurer | B63B 35/812 441/68 |
| 4,674,764 | A | | 6/1987 | Miesen | |
| 4,717,167 | A | | 1/1988 | Adam | |
| 4,844,501 | A | | 7/1989 | Lekhtman | |
| 4,871,336 | A | * | 10/1989 | Scheurer | B63B 35/812 441/70 |
| 4,898,401 | A | | 2/1990 | Champagnac | |
| 5,087,065 | A | * | 2/1992 | Provence | A43B 5/0411 280/615 |
| 5,221,104 | A | | 6/1993 | Bejean et al. | |
| 5,577,754 | A | | 11/1996 | Hwu | |
| 6,092,828 | A | | 7/2000 | Schumacher | |
| 6,193,262 | B1 | * | 2/2001 | Silva | A63C 5/075 280/602 |
| 8,333,403 | B2 | | 12/2012 | Popel | |
| 2007/0246913 | A1 | | 10/2007 | Coulbourn | |
| 2008/0174089 | A1 | * | 7/2008 | Ekberg | A63C 5/02 280/603 |
| 2010/0253021 | A1 | * | 10/2010 | Kostantin | A43B 5/0494 280/11.33 |
| 2016/0367883 | A1 | * | 12/2016 | Gasparro | A63C 7/02 |

FOREIGN PATENT DOCUMENTS

| | | |
|---|---|---|
| WO | 2014118399 | 2/2013 |
| WO | 2015001147 | 7/2013 |

* cited by examiner 1 ski
2 U-shaped rail
3 C-shaped sliding platform
7 binding
14 heel platform
15 ridges
16 bumper
17 blunt paisley claws
18 rear edge of claw
19 platform pin
20 ski pin 1 ski
2 U-shaped rail
3 C-shaped sliding platform
4 C-shaped rail
5 lower plate
6 upper plate
7 binding
41 I-shaped platform 10 pivot hole
11 slot
12 rear edge
13 front edge
40 slotted claw 1 ski
2 rail
24 sliding platform
14 heel platform
16 bumper
30 elevated corners
31 eye rod claw
32 pin
33 bracket 1 ski
42 C-shaped sliding platform
43 binding
16 front bumper
50 T-shaped rail
51 head
52 cushion
53 rear bumper
54 front heel plate
55 rear heel plate
56 row of two screws 57 wrap over plate
58 threaded pins
59 holes for threaded pins
60 washers 10 pivot hole
11 slot
12 rear edge of claw
13 front edge of claw
61 machined aluminum claw

MECHANICAL TRACTION FOR A CROSS-COUNTRY SKI

BACKGROUND OF THE INVENTION

1. Field of Invention

This invention relates to mechanical traction enhancements for snow skis.

2. Description of Related Art

In the classic style of cross-country skiing, as opposed to the skating style, traction is conventionally effected through the use of wax. During gliding the ski slips on a microscopic film of water created by friction between the ski and snow. When the ski stops, ice crystals in the snow embed in the wax, thereby creating traction. The type of wax used varies with snow temperature and texture. The wax wears off and must be re-applied. Improper waxing can inhibit gliding, give insufficient traction, or both. Changes in snow conditions can make a particular wax ineffective. Thus, ski wax cannot yield optimal results in all snow conditions at all times.

Another common means of giving traction to a ski is the practice of molding or inscribing a fish-scale pattern of scales in the base of the ski. The scales are low-inclined planes which present perpendicular biting surfaces towards the rear of the ski. These waxless skis require less learning-time, skill and effort to use, but give less satisfactory glide and traction in comparison to waxed skis. Both traction types, wax and fish-scale, will fail on steeper grades and the skier then resorts to climbing with skis in a herring bone pattern; side-stepping with skis transverse to the grade; or to removal of the skis at the bottom of the slope, walking up, and remounting the skis at the top.

With the touring or mountaineering style of nordic or alpine skis, traction is conventionally obtained by the use of natural or synthetic seal skins fixed over the underface of the ski. The skins need to be manually removed for gliding downhill. Self-adhesive skins lose adherence when wet and can leave adhesive residue on the gliding surface when removed. Clip-on skins must be manually attached and removed as needed.

Some mechanical traction devices are manually engaged and locked in a traction position when needed, and manually disengaged when no longer needed. Examples of such manually engaged traction devices can be found in U.S. Pat. No. 4,148,500 to Nidecker; U.S. Pat. No. 4,564,210 to Case; and U.S. Pat. No. 4,898,401 to Champagnac and in US patent application publication No. 2007/0246913 to Coulbourn. When engaged, such manually locked traction devices cannot provide tractionless gliding.

Some mechanical traction devices mechanically engage traction as the skier's heel lifts off the ski or as the ski is unweighted, and disengage traction as the heel is lowered or the ski is weighted. Examples of such heel-lift solutions can be found in U.S. Pat. No. 4,717,167 to Adam; U.S. Pat. No. 5,577,754 to Hwu; and U.S. Pat. No. 8,333,403 to Popel. Such heel-lift solutions have the disadvantage that the engagement and disengagement of the traction mechanism are not synchronized with the push-off and gliding phases defined by the classic style of cross-country skiing. In the classic style, the push-off phase begins before the heel lifts, and the gliding phase begins while the skier's heel is still raised. Accordingly, such heel-lift solutions will result in a lack of traction at the beginning of the push-off phase when it is needed most, and will result in undesirable drag when the ski is contacting the snow at the beginning of the gliding phase.

Some mechanical traction devices include a freely moveable traction element disposed along a side edge of a ski. Such traction element is freely moveable under the force of gravity and by mechanical contact with the snow surface. When the ski is moved forward along the surface of the snow, such as during forward gliding, the traction element is intended to move to a disengaged position in response to its contact with the snow surface. When the ski is lifted above the snow, the traction element is intended to move to an engaged position in response to the force of gravity acting on the traction element. When the ski is moved rearward along the surface of the snow, the freely moveable traction element is intended to move into an engaged position penetrating into the snow to provide traction for a forward push-off. Examples of such traction devices can be found in U.S. Pat. No. 4,674,764 to Miesen; U.S. Pat. No. 5,221,104 to Bejean et al.; U.S. Pat. No. 6,092,828 to Schumacher; and U.S. Pat. No. 4,844,501 to Lekhtman. However, such freely moveable traction element does not engage until after the ski has moved sufficiently rearward to complete the movement of the traction element into its engaged position. Thus, such freely moveable traction devices have the disadvantage that no traction is provided at the beginning of a push-off when it is needed most. In the case of hard-packed snow or ice, such freely moveable traction element may not move to its engaged position, thereby causing a loss of the device's traction. When the ski is lowered onto the snow just before forward ski motion, the possibility remains that such freely moveable traction element, instead of remaining in an engaged position and penetrating the snow, may move to its disengaged position causing a loss of the device's traction. Lowering the ski with a simultaneous rearward motion would increase the probability of the traction element remaining engaged, but doing so has the disadvantage of requiring the ski to be lifted and moved rearward along the snow surface with every forward step.

OBJECTS OF THE INVENTION

An object of the invention is to address the above shortcomings. Further objects may include providing a mechanical traction device for skis that can be engaged without dismounting the ski; that is actuated by means other than the lifting of a skier's heel; and that does not use the force of gravity to move a traction element of the device into an engaged position.

SUMMARY

The above shortcomings may be addressed by providing, in accordance with one aspect of the invention, a ski for traveling on snow-covered ground, the ski having a longitudinal body defining a sole for contacting the snow-covered ground. The ski includes: (a) a platform slidably coupled to the body for sliding longitudinally relative to the body; and (b) at least one gripping element coupled to the body and the platform for extending in a direction perpendicular to the sole in response to the platform being slid longitudinally relative to the body.

The at least one gripping element may be operable to extend in a first perpendicular direction perpendicular to the sole in response to the platform sliding in a first longitudinal direction relative to the body. The at least one gripping element may be operable to retract in a second perpendicular direction opposite the first perpendicular direction in response to the platform sliding in a second longitudinal direction opposite the first longitudinal direction. The body may define a forward direction toward a front section of the ski. The body may define a downward direction through the body perpendicularly toward the sole. The first perpendicular direction may be the downward direction. The first longitudinal direction may be a rearward direction opposite the forward direction. The second perpendicular direction may be an upward direction opposite the downward direction. The second longitudinal direction may be the forward direction. The at least one gripping element may be dimensioned for extending beyond the body when the platform is slid in the rearward direction sufficiently relative to the body. The at least one gripping element may be dimensioned for extending beyond the body in the downward direction so as to penetrate into snow of the snow-covered ground when the platform is slid in the rearward direction sufficiently relative to the body. The at least one gripping element may be dimensioned for not extending beyond the body when the platform is slid in the forward direction sufficiently relative to the body. The at least one gripping element may be dimensioned for not extending beyond the body in the downward direction when the platform is slid in the forward direction sufficiently relative to the body. The at least one gripping element may be rotatably coupled to the platform. The at least one gripping element may be slidably coupled to the body. The at least one gripping element may be rotatably coupled to the body. The at least one gripping element may be slidably and rotatably coupled to the body. The ski may include a first bumper attached to the body for limiting the sliding travel of the platform. The ski may include a second bumper attached to the body for limiting the sliding travel of the platform. The ski may include the first and second bumpers attached to the body for limiting the sliding travel of the platform. The ski may include a front bumper attached to the body for limiting the forward sliding travel of the platform. The ski may include a rear bumper attached to the body for limiting the rearward sliding travel of the platform. The ski may include the front and rear bumpers attached to the body for limiting the forward and rearward sliding travel of the platform. The platform may be coupled to the body at an upper side of the body opposite the sole. The platform may be operable to resist sliding relative to the body in response to receiving pressure in the downward direction toward the body. The platform may include a binding for receiving a ski boot. The platform may be operable to receive the pressure from the ski boot. The at least one gripping element may include first and second elements disposed on opposing sides of the body. The first element may be operable to extend in the direction perpendicular to the sole in response to the platform being slid longitudinally relative to the body. The second element may be operable to extend in the direction perpendicular to the sole in response to the platform being slid longitudinally relative to the body. The ski may further include a locking mechanism for locking the platform so as to prevent longitudinal sliding of the platform when the locking mechanism is engaged. The locking mechanism may be operable to lock the platform in a locked position selected from the group consisting of: a forward position, one or more intermediate positions and a rearward position.

In accordance with another aspect of the invention, there is provided a ski-traction kit for retrofitting a ski, the ski being operable to travel on snow-covered ground and having a longitudinal body defining a sole for contacting the snow-covered ground. The kit includes: (a) a platform dimensioned for being coupled to the body such that the platform becomes longitudinally slidable relative to the body; and (b) at least one gripping element dimensioned for being coupled to the body and the platform such that the at least one gripping element becomes extendable in a direction perpendicular to the sole in response to the platform being slid longitudinally relative to the body.

The kit may further include instructions for coupling the platform to the body. The kit may further include instructions for coupling the at least one gripping element to the body and the platform.

Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings which illustrate by way of example only embodiments of the invention.

DETAILED DESCRIPTION

A ski for traveling on snow-covered ground, the ski having a longitudinal body defining a sole for contacting the snow-covered ground, comprises: (a) platform means for sliding longitudinally relative to the body; and (b) snow-gripping means for extending in a direction perpendicular to the sole in response to the platform means sliding longitudinally relative to the body.

Figure 1:
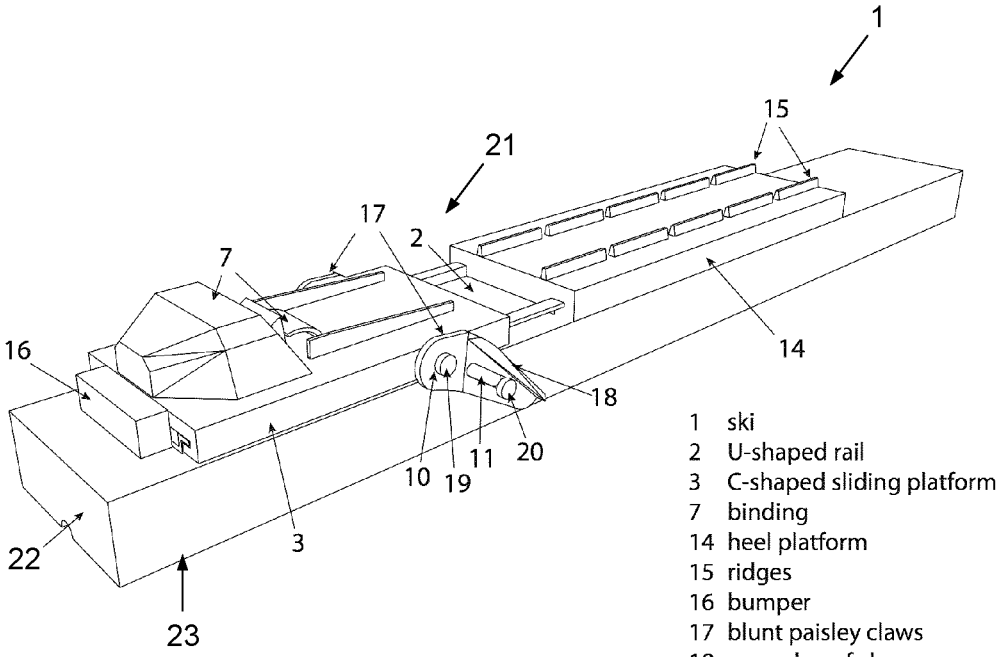
FIG. 1 is a perspective view of a portion of a ski for traveling on snow-covered ground, showing a traction device according to a first embodiment of the invention in a disengaged position.
Figure 2:
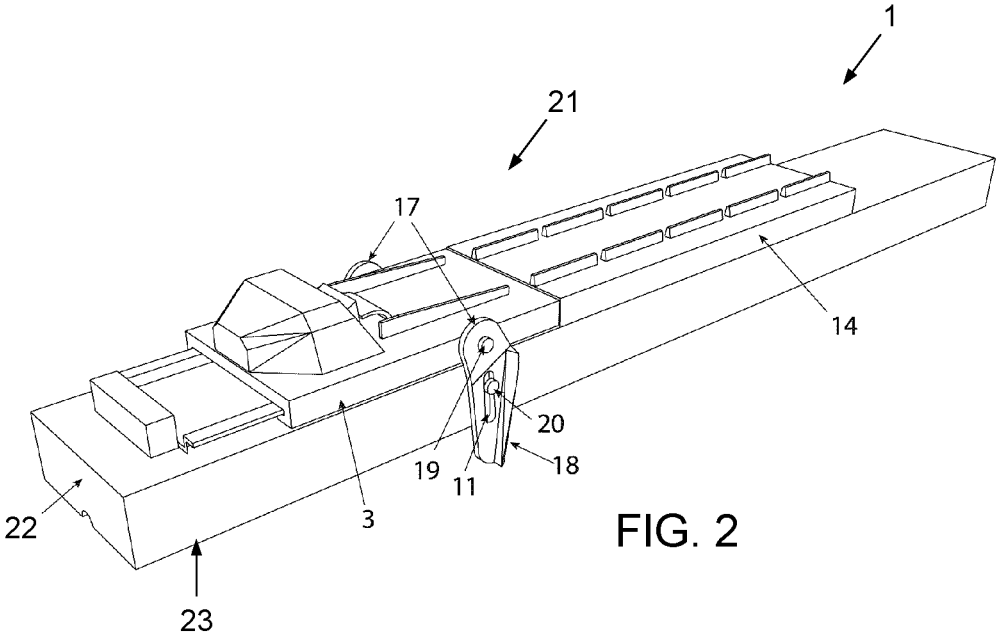
FIG. 2 is a perspective view of the portion of the ski shown in FIG. 1, showing the traction device in an engaged position.

Referring to FIGS. 1 and 2, a portion of the ski according to a first embodiment of the invention is shown generally at 1. The ski 1 is useable for traveling on snow-covered ground (not shown). The ski 1 includes a mechanical traction device 21 according to the first embodiment of the invention.

The ski 1 includes a rail, such as the U-shaped rail 2 shown in FIGS. 1 and 2 attached to an upper surface of the longitudinal main part or ski body 22 of the ski 1. A platform, such as the C-shaped sliding platform 3 shown in FIGS. 1 and 2, is shown coupled to the ski 1 via the rail 2. In the first embodiment, the sliding platform 3 is slidably coupled to the rail 2, thereby allowing the platform 3 to slide longitudinally along the ski body 22. FIG. 1 shows the sliding platform 3 in its longitudinally forward position toward a front section (not shown) of the ski 1, and FIG. 2 shows the sliding platform 3 in its longitudinally rearward position toward a rear section (not shown) of the ski 1.

Figure 3A:
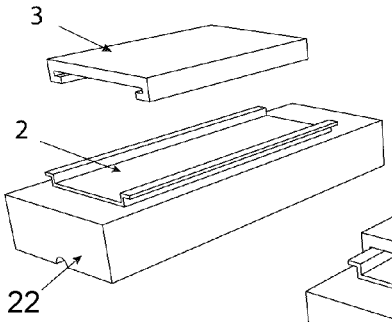
FIG. 3A is a perspective view of a lesser portion of the ski shown in FIG. 1, showing an exploded view of a C-shaped sliding platform and a U-shaped rail.
Figure 3B:
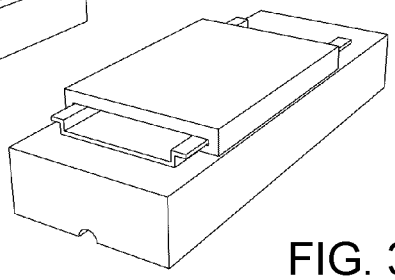
FIG. 3B is a perspective view of the lesser portion shown in FIG. 3A, showing the C-shaped sliding platform assembled to the U-shaped rail.

FIGS. 3A and 3B show a lesser portion of the ski 1 for ease of illustration. In the first embodiment, the rail 2 is mounted to the ski body 22 and does not move relative to the ski body 22. The rail 2 has a transverse cross-section that is substantially U-shaped, and the sliding platform 3 has a transverse cross-section that is substantially C-shaped. Also, the sliding platform 3 is dimensioned to wrap around or otherwise engage the rail 2 so that the sliding platform 3 is operable to move longitudinally relative to the ski body 22 by sliding along the rail 2. Typically, the sliding platform 3 is restricted from moving along any axis other than the longitudinal axis defined by the longitudinal body 22, including being restricted from rotating about any axis.

Figure 4A:
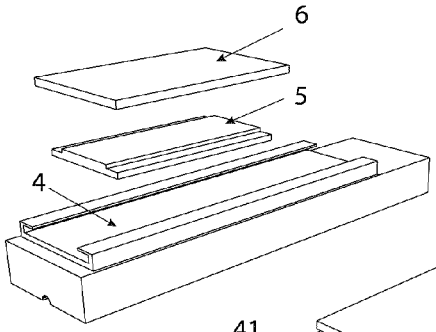
FIG. 4A is an exploded view of a variation of the sliding platform and rail shown in FIGS. 3A and 3B, showing a C-shaped rail, a lower plate and an upper plate.
Figure 4B:
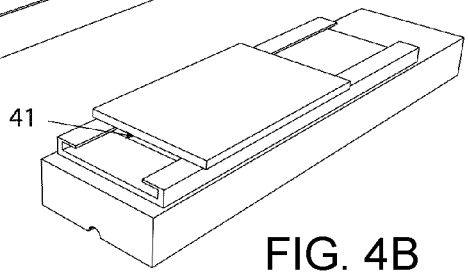
FIG. 4B is a perspective view of the variation shown in FIG. 4A, showing the variation in its assembled form.

Referring to FIGS. 4A and 4B, the sliding platform 3 may be implemented in any suitable manner including as the I-shaped sliding platform 41 shown in its assembled state in FIG. 4B. The rail 4 shown in FIGS. 4A and 4B is mounted to the ski body 22 and has a transverse cross-section that is substantially C-shaped. The I-shaped platform 41 includes a lower plate 5 that is step-notched along its longitudinal side edges to give its transverse cross-section the shape of an inverted "T". The inverted-T-shaped lower plate 5 at its side edges is dimensioned for fitting under the lip defined by the C-shaped rail 4. The I-shaped platform 41 also includes an upper plate 6 having six sides and a transverse cross-section that is substantially rectangular. In its assembled form shown in FIG. 4B, the lower plate 5 and the upper plate 6 are attached to each other to define the "I" shape of the sliding platform 41 with 180-degree rotational symmetry. The sides of the C-shaped rail 4 wrap into the opposing gaps of the sides of the I-shaped platform 41 to permit the sliding platform 41 to move longitudinally relative to the ski body 22 by sliding along the rail 4. Typically, the sliding platform 41 is restricted from moving along any axis other than the longitudinal axis defined by the longitudinal body 22, including being restricted from rotating about any axis.

While FIGS. 3A, 3B, 4A and 4B show two variations of a sliding platform, many other variations of sliding platforms can be implemented in accordance with embodiments of the invention, such as using a linear glide or a platform with longitudinal perforations which slide along rods. In some embodiments, the rail 2, rail 4 or other rail is integrally attached to the ski body 22. In some embodiments, the rail is implemented as a groove cut into the ski body 22, and the sliding platform is dimensioned to include a longitudinal projection for engaging the groove to permit the sliding platform to move longitudinally relative to the ski body 22. Generally, any variation of sliding platform that suitably provides for reciprocating motion longitudinally along the ski body 22 is within the scope contemplated by the present invention.

Figure 5:
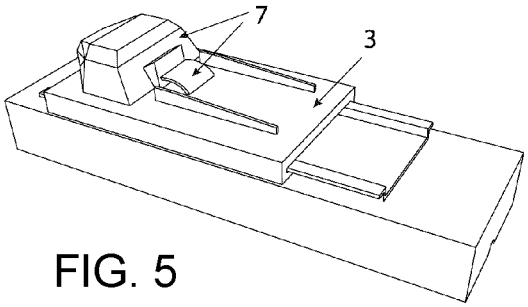
FIG. 5 is a perspective view of the lesser portion shown in FIG. 3B, showing a binding.

Referring to FIGS. 1, 2 and 5, a binding 7 is attached to the sliding platform 3 in accordance with the first embodiment. The illustrated binding 7 is for ski boots having a single lateral pin at the toe, but any binding of any configuration or type suitable for cross-country or touring skis will work in conjunction with any embodiment of the present invention. In variations, various parts or the whole of the binding 7 may be removably attachable to the sliding platform 3, attached by fasteners to the sliding platform 3, integrally attached to the sliding platform 3, or any combination thereof for example. In some embodiments, it is preferable to mold or print plastic component(s) of the binding 7 together with the sliding platform 3. Doing so might increase strength and help lower the total profile of the traction device 21 above the ski body 22. A lower profile can advantageously give better overall lateral stability, reduce the tendency for the ski 1 to roll, and provide more control in the snowplow style of descent. In general, however, any binding operable to attach a ski boot to the ski 1 may be suitably employed.

Referring back to FIGS. 1 and 2, the ski 1 in accordance with the first embodiment includes a gripping element, such as the claw 17 shown in FIGS. 1 and 2 as having the approximate shape of a blunted paisley. The paisley-shaped claw 17 is operable to retract above the bottom surface or sole 23 of the ski body 22 to a disengaged position of the traction device 21 when the sliding platform 3 is in its forward position, as shown in FIG. 1. The claw 17 is also operable to extend below the ski body 22, such as in a downward direction defined as extending through the ski body 22 perpendicularly toward the sole 23, to an engaged position of the traction device 21 when the sliding platform 3 is in its rearward position, as shown in FIG. 2.

The claw 17 includes an aperture, such as the pivot hole 10 in FIGS. 1 and 2, that is dimensioned to receive a projection, such as the platform pin 19 attached to the side of the sliding platform 3 as shown in FIGS. 1 and 2, such that the claw 17 becomes rotatably coupled to the sliding platform 3 via the platform pin 19 and its pivot hole 10. In some embodiments, the platform pin 19 is fastened to the sliding platform 3. However, in the first embodiment the platform pin 19 is integrally attached to the sliding platform 3, such as by being molded or machined as part of the sliding platform 3 for example.

The claw 17 also includes an elongated aperture, such as the slot 11 shown in FIGS. 1 and 2, that is dimensioned to receive a second projection, such as the ski pin 20 attached to the side of the ski body 22 as shown in FIGS. 1 and 2, such that the claw 17 becomes slidably and rotatably coupled to the ski body 22 of the ski 1. In some embodiments, the ski pin 20 is integrally attached to the ski body 22, such as during manufacturing of the ski 1 for example. However, in the first embodiment, the ski pin 20 is fastened to the ski body 22 in any suitable manner, including transversely passing through the ski body 22 so as to form opposing ski pins 20 on opposing sides of the ski body 22 for example.

The rotational coupling between the claw 17 and the sliding platform 3 and the rotational and sliding coupling between the claw 17 and the ski body 22 advantageously causes the claw 17 to move between the disengaged and engaged positions in response to longitudinal movement of the sliding platform 3 relative to the ski body 22.

In the first embodiment shown in FIGS. 1 and 2, the claw 17 includes a rear edge 18 projecting in a transverse direction away from the side of the ski body 22. Typically, the rear edge 18 is formed by a bend, such as a 90-degree bend, in the material of the claw 17. The rear edge 18 advantageously provides a transverse surface to push against snow when the claw 17 is penetrating into the snow.

Figure 6A:
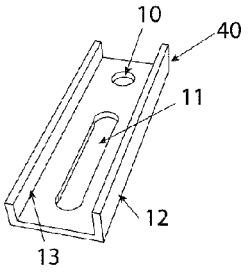
FIG. 6A is a perspective view of a rectangular U-shaped claw for use according to embodiments of the invention, showing the obverse side of the rectangular U-shaped claw.
Figure 6B:
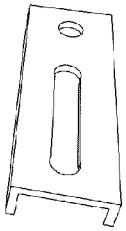
FIG. 6B is a perspective view of the rectangular U-shaped claw shown in FIG. 6A, showing the reverse side of the rectangular U-shaped claw.

Referring to FIGS. 6A and 6B, the gripping element may alternatively be formed as a rectangular U-shaped claw 40. The U-shaped claw 40 may be made of any suitable material, such as sheet metal for example. Both the paisley-shaped claw 17 of FIGS. 1 and 2 and the U-shaped claw 40 of FIGS. 6A and 6B include an aperture such as the pivot hole 10 and an elongated aperture such as the slot 11, such that the paisley-shaped claw 17 and the U-shaped claw 40 are advantageously interchangeable in embodiments of the invention. The U-shape of the claw 40 is formed by a rear edge 12 and a front edge 13. Typically, a pair of U-shaped claws 40 is opposedly oriented such that the obverse sides of each U-shaped claw 40 is directed outwardly from a respective side edge of the ski body 22 (FIGS. 1 and 2). The U-shaped claw 40 advantageously provides low cost and ease of manufacturing.

Referring back to FIGS. 1 and 2, the ski 1 in accordance with the first embodiment includes a heel platform 14 dimensioned to support a heel portion of a ski boot (not shown) during use of the ski 1. In the first embodiment, the top of the heel platform 14 is generally at the same height from the ski body 22 as the top of the sliding platform 3, thereby advantageously supporting a ski boot at a level position for enhanced user comfort. Typically, the heel platform 14 includes ridges 15 for gripping the sole of the ski boot (not shown). In variations, any desired style of ridges 15 may be suitably employed.

In the first embodiment shown in FIGS. 1 and 2, the heel platform 14 abuts a rear face of the rail 2, thereby serving to limit the rearward travel of the sliding platform 3. The forward travel of the sliding platform 3 is limited in the first embodiment by a front bumper 16 abutting a front face of the rail 2. Preferably, the front bumper 16 is made of a resilient material, such as rubber for example, that renders the front bumper 16 operable to resiliently absorb impacts by the sliding platform 3 and consequently reduce the noise of such impacts. The forward and rearward limits of travel of the sliding platform 3 correspondingly limit the rotation of the claw 17 or similar about the platform pin 19 and the rotation and sliding of the claw 17 or similar about the ski pin 20, thereby defining the placement of the claw 17 in the disengaged and engaged positions, respectively. Additionally or alternatively, the forward and/or rearward travel of the sliding platform 3 may be limited by the length and position of the slot 11 in conjunction with the placement of the ski pin 20. In the first embodiment, the forward travel of the sliding platform 3 is limited to coincide with the claw 17 being raised above the sole 23 of the ski 1, and the rearward travel of the sliding platform 3 is limited to coincide with the claw 17 maximally extending vertically in the downward direction.

Second Embodiment

Figure 7:
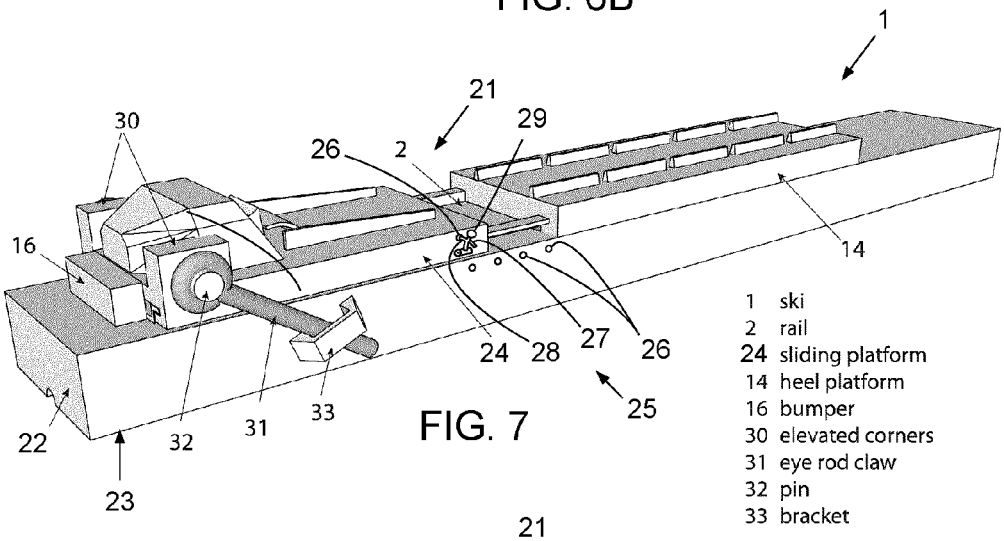
FIG. 7 is a perspective view of a portion of a ski for traveling on snow-covered ground, showing a traction device according to a second embodiment of the invention in a disengaged position.
Figure 8:
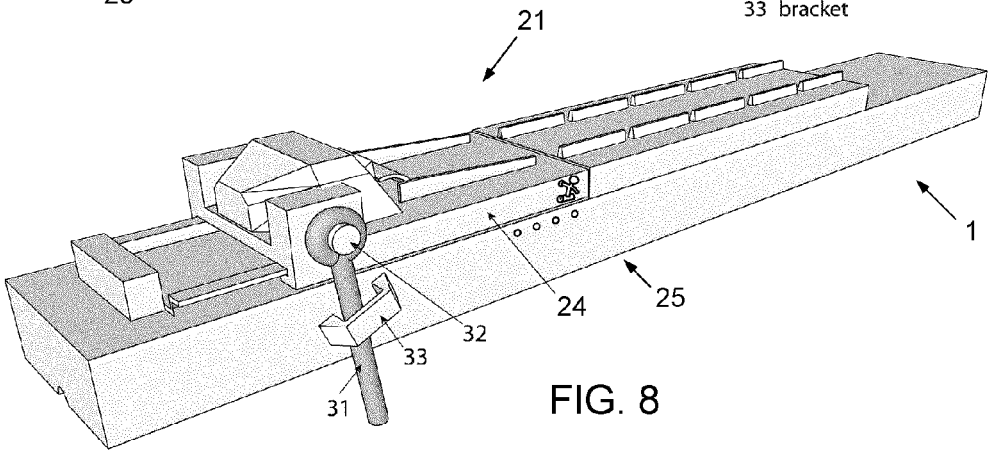
FIG. 8 is a perspective view of the portion of the ski shown in FIG. 7, showing the traction device in an engaged position.

Referring to FIGS. 7 and 8, a ski 1 and a traction device 21 in accordance with a second embodiment of the invention includes a sliding platform 24 according to the second embodiment. The sliding platform 24 has elevated front corners 30 for supporting a platform pin 32 that passes through the eye of an eye-rod claw 31. The pin 32 may also extend transversely between the front corners 30 to pass, at opposing ends thereof, through the respective eyes of a pair of opposed eye-rod claws 31 (the far claw 31 not being visible in FIGS. 7 and 8).

In the second embodiment, each eye-rod claw 31 is rotatably coupled to the sliding platform 24. In variations, the eye-rod claw 31 may be rotatably coupled to the pin 32, the pin 32 may be rotatably coupled to the sliding platform 24 at its front corners 30, or both the eye-rod claw 31 may be rotatably coupled to the pin 32 and the pin 32 rotatably coupled to the sliding platform 24.

The pin 32 is loosely held by a bracket 33 of the second embodiment, which permits the pin 32 to rotate as it slides through the bracket 33 in response to longitudinal movement of the sliding platform 24. The bracket 33 is preferably inclined slightly to facilitate full movement of the eye-rod claw 31. In the second embodiment, the elevated front corners 30 advantageously permit a greater vertical distance between the two axes of rotation of the eye-rod claw 31, namely the axis of rotation at the pin 32 and the axis of rotation at the bracket 33. FIG. 7 shows the sliding platform 24 moved fully forward to place the traction device 21 in its disengaged position with the eye-rod claw 31 resting above the sole 23 of the ski 1; and FIG. 8 shows the sliding platform 24 moved fully rearward to place the traction device 21 in its engaged position with the eye-rod claw 31 extending downward below the sole 23 of the ski 1.

While FIGS. 7 and 8 show the sliding platform 24 having a substantially C-shaped cross-section where it engages the U-shaped rail 2, in the manner of the first embodiment's sliding platform 3 shown in FIGS. 1 and 2, 3A, 3B, and 5, in some embodiments the I-shaped sliding platform 41 and C-shaped rail 4 shown in FIGS. 4A and 4B are suitably employed in accordance with the second embodiment, with necessary changes being made to the sliding platform 41 to incorporate the elevated front corners 30 according to the second embodiment. In general, any suitable variation of sliding platform, including sliding platform variations not shown in FIGS. 3A, 3B, 4A and 4B, may be employed in accordance with either or both of the first and second embodiments of the invention.

The traction device 21 in some embodiments includes a locking mechanism, such as the platform lock 25 shown in FIGS. 7 and 8, which permits the skier to selectively lock the traction device 21 in the engaged position, with the eye-rod claw 31 down; in the disengaged position, with the eye-rod claw 31 up above the sole 23; and in one or more intermediate positions between the engaged position and the disengaged position. The platform lock 25 is moveably coupled to the sliding platform 24, such as by being hingedly connected to the sliding platform 24. Receiving members, such as the apertures 26 shown in FIGS. 7 and 8, on the ski body 22 are dimensioned to receive a first locking member 27 of the platform lock 25, thereby locking the sliding platform 24 to a single longitudinally locked position. Placing the sliding platform 24 to a locked position advantageously locks the eye-rod claw 31 to a corresponding locked position. One aperture 26 is also provided on the sliding platform 24 to receive a second locking member 28 of the platform lock 25 for stabilizing the unlocked position of the platform lock 25 when not in use. An actuation member 29 is operable to receive mechanical pressure, such as from a ski pole, to move the platform lock 25 between its unlocked position and each of its locked positions.

In variations, the locking mechanism may, for example, selectively lock the traction device 21 only in the engaged position; in both the engaged and disengaged position; or in the engaged, disengaged and one or more intermediate positions. Locking the traction device 21 in the engaged position advantageously facilitates skiing long ascents, and advantageously facilitates skiing steep or otherwise challenging descents in which the locked traction device 21 can provide continuous braking for enhanced safety and control. Locking the traction device 21 in its disengaged position can be useful when the skier wishes to perform quick jumps and turns, for example, without risking unintended engagement of the traction device 21. Locking the traction device 21 in its disengaged position can also be useful when applying wax to the sole 23 by preventing the claws 31 from crossing the plane of the sole 23.

While FIGS. 7 and 8 show the platform lock 25 applied to the traction device 21 of the second embodiment, the platform lock 25 is operable in accordance with any embodiment of the present invention. While FIGS. 7 and 8 show a locking mechanism implemented as the platform lock 25, the locking mechanism may be implemented using any suitable means, including locking the eye-rod claw 31 or other gripping element directly to the bracket 33 (or similar) and/or the ski body 22 for example. Locking mechanisms that can be actuated without dismounting from the ski 1, such as locking mechanisms actuated by hand or by a ski pole, are preferable to locking mechanisms that require dismounting from the ski 1 for actuation.

Third Embodiment

Referring to FIGS. 9 to 12, a ski 1 and a traction device 21 in accordance with a third embodiment of the invention includes a rail 50 having a transverse cross-section that is substantially T-shaped. The rail 50 is mounted to the ski body 22 of the ski 1. The sliding platform 42 according to the third embodiment has a transverse cross-section that is C-shaped, and the sliding platform 42 is dimensioned to wrap around the T-shaped edges of the rail 50 to permit the sliding platform 42 to slide longitudinally while restricting its movement along other axes, including restricting rotation about any axis.

Figure 9:
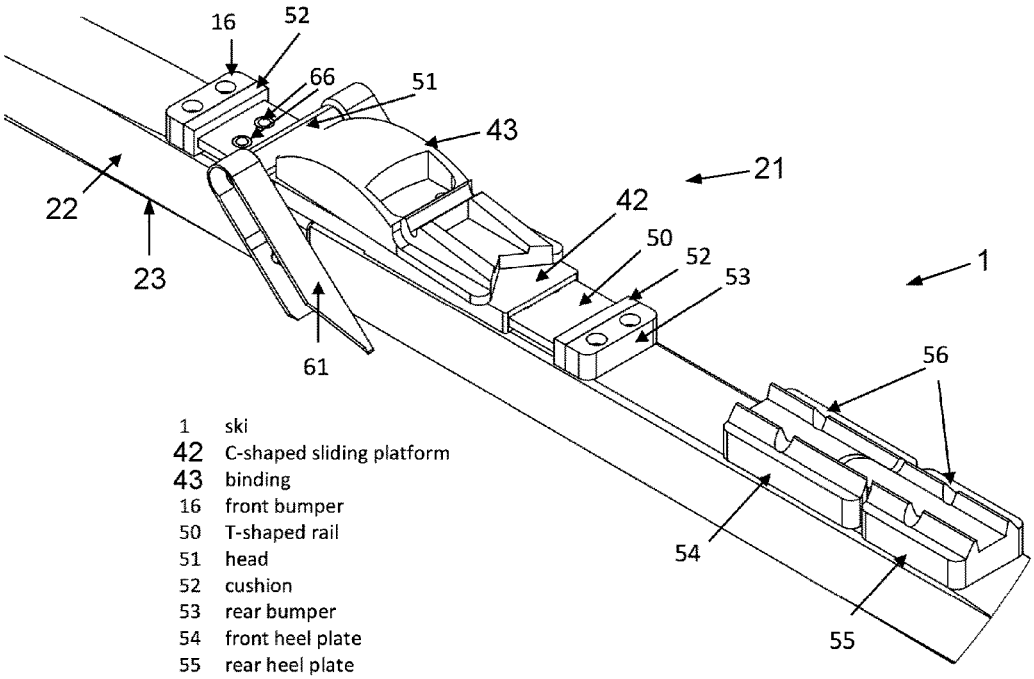
FIG. 9 is a perspective view of a portion of a ski for traveling on snow-covered ground, showing a traction device according to a third embodiment of the invention in a partly engaged position.
Figure 10:
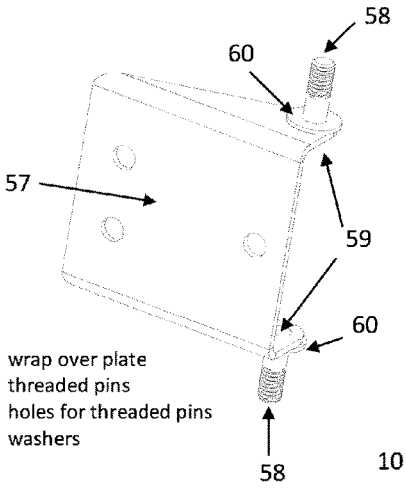
FIG. 10 is a perspective view of a wrap-over plate for use with the portion shown in FIG. 9, showing threaded pins.
Figure 12:
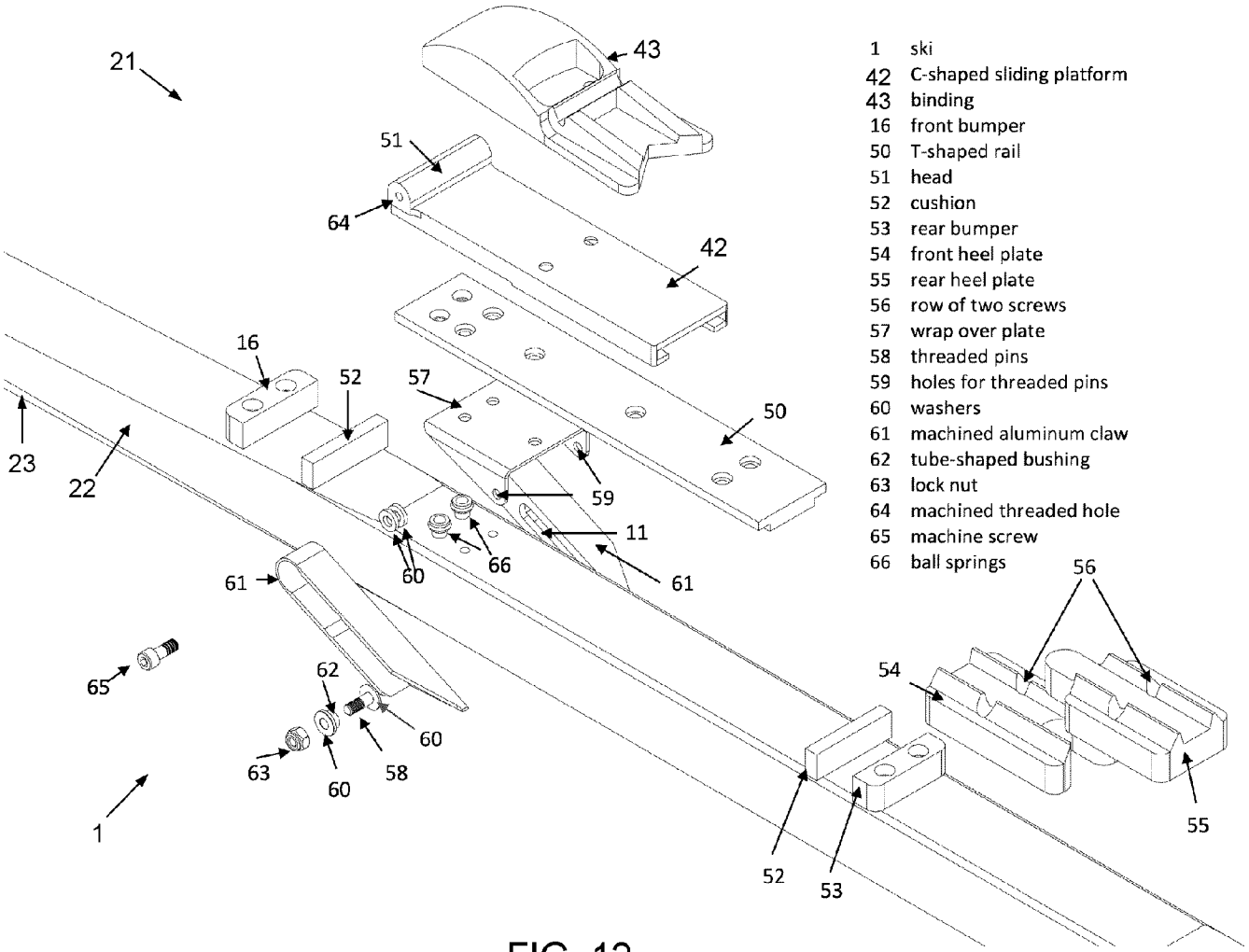
FIG. 12 is an exploded view of the traction device shown in FIG. 9, showing an aperture in a head of a C-shaped sliding platform.

While FIGS. 9 and 12 show the sliding platform 42 having a substantially C-shaped cross-section, in the manner of the first embodiment's sliding platform 3 shown in FIGS. 1 and 2, 3A, 3B, and 5, in some embodiments the I-shaped sliding platform 41 and C-shaped rail 4 shown in FIGS. 4A and 4B are suitably employed in accordance with the third embodiment, with necessary changes being made to the sliding platform 41 to incorporate the head 51 according to the third embodiment. In general, any suitable variation of sliding platform, including sliding platform variations not shown in FIGS. 3A, 3B, 4A and 4B, may be employed in accordance with any of the first, second and third embodiments of the invention. In general, the U-shaped rail 2 shown in FIGS. 1, 2, 3A, 3B and 5 is interchangeable with the T-shaped rail 50 shown in FIGS. 9 and 12, with any necessary changes being made to the sliding platform at its underface.

The sliding platform 42 includes or has attached thereto a binding 43 for receiving a ski boot (not shown). The binding 43 may be implemented in any suitable manner, including being similar or identical to, or different from, the binding 7 shown in FIGS. 1, 2 and 5.

Figure 11:
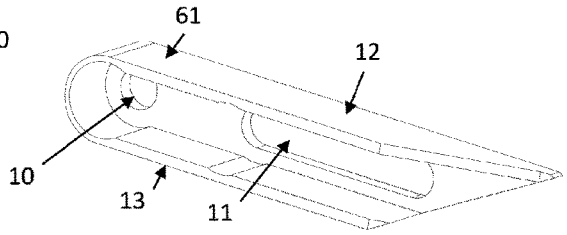
FIG. 11 is a perspective view of an angled U-shaped claw for use according to embodiments of the invention, showing the obverse side of the angled U-shaped claw.

The ski 1 according to the third embodiment includes a gripping element, such as the angled U-shaped claw 61 shown in FIGS. 9, 11 and 12. The U-shaped claw 61 may be made of any suitable material by any suitable manufacturing process, such as machined aluminum for example. The paisley-shaped claw 17 of FIGS. 1 and 2, the rectangular U-shaped claw 40 of FIGS. 6A and 6B, and the angled U-shaped claw 61 of FIGS. 9, 11 and 12 include an aperture, such as the pivot hole 10, and an elongated aperture, such as the slot 11, such that the paisley-shaped claw 17, the rectangular U-shaped claw 40, and the angled U-shaped claw 61 are advantageously interchangeable in embodiments of the invention. As best seen in FIG. 11, the U-shape of the claw 61 is formed by a rear edge 12 and a front edge 13 that together provide rigidity to the angled U-shaped claw 61. Typically, a pair of angled U-shaped claws 61 is opposedly oriented such that the obverse sides of each angled U-shaped claw 61 is directed outwardly from a respective side edge of the ski body 22, as shown in FIG. 9. The lower ends of the front edge 13 and the rear edge 12 of the angled U-shaped claw 61 are tapered to advantageously reduce drag when gliding while maximizing traction during push-off.

Still referring to FIGS. 9 to 12, the sliding platform 42 is operable to rotatably couple a gripping element such as the angled U-shaped claw 61, and includes a head 51 for supporting a platform pin such as the machine screw 65 as is best seen in FIG. 12. The head 51 is preferably integrally formed with the remainder of the sliding platform 42 and extends transversely across the sliding platform 42 at its forward end. Typically, the head 51 includes a threaded aperture 64, best seen in FIG. 12, for receiving the machine screw 65. When the machine screw 65 is threaded into the threaded aperture 64, a first washer 60 is typically disposed on the machine screw 65 between the side of the head 51 and the inner face of the angled U-shaped claw 61, and a second washer 60 is typically disposed on the machine screw 65 between the outer face of the angled U-shaped claw 61 and the head of the machine screw 65, thereby advantageously reducing friction therebetween, respectively.

In the third embodiment, the angled U-shaped claw 61 is slidably and rotatably coupled to the ski body 22 of the ski 1 via a wrap-over plate 57 having a pair of pin holes 59 in which threaded pins 58 are attached, such as by welding. Typically, a lock nut 63, a tube-shaped bushing 62 and a pair of washers 60 are employed to secure the coupling between the angled U-shaped claw 61 and the wrap-over plate 57. The tube-shaped bushing 62 typically rotates freely on the threaded pin 58 and is dimensioned to be received into the slot 11, thereby advantageously reducing friction between the threaded pin 58 and the angled U-shaped claw 61. The washer 60, which may be made from nylon or other similar material, advantageously reduces wear and friction between the vertical face of the wrap-over plate 57 and the inner face of the angled U-shaped claw 61.

The wrap-over plate 57 includes a horizontal face dimensioned to be received into a recess cut into the bottom side of the rail 50, with the rail 50 and the wrap-over plate 57 at its horizontal face having aligned apertures through which fasteners, such as screws, pass when the rail 50 and the wrap-over plate 57 are attached to the ski body 22 of the ski 1. By use of the wrap-over plate 57, the third embodiment advantageously provides coupling between a claw, such as the angled U-shaped claw 61, and the ski body 22 without requiring attachment of any component at or into the side edges of the ski body 22, which is particularly advantageous in the case of foam-core skis for example.

Still referring to FIGS. 9 to 12, the forward travel of the sliding platform 42 is limited by the placement of the front bumper 16 and its accompanying front cushion 52. In the third embodiment, the front cushion 52 is disposed between the front bumper 16 and a front face of the rail 50. The rearward travel of the sliding platform 42 is limited by the placement of a rear bumper 53 and its accompanying rear cushion 52. In the third embodiment, the rear cushion 52 is disposed between a rear face of the rail 50 and the rear bumper 53. The front and rear cushions 52 are typically made of a resilient material, such as rubber, for resiliently absorbing impacts from the sliding platform 42 and thereby reducing the noise of such impacts. The front and rear bumpers 16 and 52 and their accompanying cushions 52 may be attached to the ski body 22 in any suitable manner, including by the use of fasteners, adhesive or both fasteners and adhesive for example. Typically, the front and rear bumpers 16 and 53 and their accompanying cushions 52 are mounted on the ski 1 such that the sliding platform 42 has sufficient longitudinal play to engage and disengage the traction device 21 but no more.

In the third embodiment, the ski 1 includes a two-piece heel plate made of a front heel plate 54 and a rear heel plate 55, each of which is attached to the ski body 22 by fasteners, such as screws, passing through a single transverse row of screw holes in each of the plates 54 and 55. The front and rear heel plates 54 and 55 are typically separated from each other by a spacing in the range of one to two millimeters. Such spacing and the transverse orientation of the rows of fasteners advantageously avoid restricting ski flex about a transverse axis. The respective edges of the front and rear heel plates 54 and 55 that face each other are configured in mortise-and-tenon fashion, thereby advantageously restricting ski flex about a vertical axis (i.e. yaw).

Optionally, embodiments of the invention may include ball springs 66 (FIGS. 9 and 12) that are at least partly embedded into the rail 50 near the front end of the rail 50. Such ball springs 66 are dimensioned to make frictional contact with the sliding platform 3, 41, 24 and/or 42 when it is sufficiently forward along its longitudinal track. Such frictional contact provides a measure of hindrance against longitudinal movement of the sliding platform 3, 41, 24 and/or 42 relative to the ski body 22, which may provide enhanced comfort or greater useability for some skiiers, especially when the ski 1 is lifted after gliding.

Method of Assembly

Referring to FIG. 12, a method of assembling the angled U-shaped claw 61 to the sliding platform 42 in accordance with the third embodiment of the invention involves: (a) placing a first washer 60 onto the threaded pin 58 against the wrap-over plate 57, the threaded pin 58 having been welded into the pin hole 59 of the wrap-over plate 57; (b) placing one tube-shaped bushing 62 onto the threaded pin 58; (c) placing the angled U-shaped claw 61 onto the threaded pin 58 such that the threaded pin 58 and the tube-shaped bushing 62 passes through and becomes disposed within the slot 11; (d) placing a second washer 60 onto the threaded pin 58 against the angled U-shaped claw 61; (e) threading one lock nut 63 onto the threaded pin 58; (f) tightening the lock nut 63; (g) placing a third washer 60 onto a machine screw 65; (h) placing the machine screw 65 through the pivot hole 10, through a fourth washer 60, and into the threaded aperture 64; and (i) tightening the machine screw 65.

This method of assembling the angled U-shaped claw 61 to the sliding platform 42, or similar, is typically employed to assemble a second claw 61 on the opposing side of the sliding platform 42.

Variations of Embodiments

While the claws 17, 40, 31 and 61 can be rotatably coupled to the sliding platforms 3, 41, 24 and 42, in various combinations thereof, and can be slidably and rotatably coupled to the ski body 22 by the exemplary techniques described and illustrated herein, any suitable technique for converting the reciprocating motion of the sliding platform 3, 41, 24 or 42 into extension and retraction of the claw 17, 40, 31 or 61 may be suitably employed. By way of example only, some embodiments may include a plurality of claws 17, 40, 31 and/or 61 on one or both sides of the ski body 22. Some embodiments include flaps, louvres or the like along the sole 23 that are lowered and raised in response to reciprocating motion of a top-mounted sliding platform 3, 41, 24 or 42. However, the specific embodiments described in detail and illustrated herein advantageously do not modify the gliding surface or sole 23 of the ski 1. Other variations of the embodiments described and illustrated herein are possible.

The claws 17, 40, 31 and 61 may be made of any suitable material, such as metal, fiberglass, wood, plastic, other related materials, or any combination thereof. The claws 17, 40, 31 and 61 may be formed by casting, molding, extruding, forging, rolling, machining, printing, other similar manufacturing processes, or any combination thereof for example. Specific examples of materials for the claws 17, 40, 31 and 61 include sheet metal, iron, carbon steel, stainless steel, forged steel, cast aluminum, and molded plastic.

Generally, the claws 17, 40 and 61 are interchangeable with each other, and may be swapped during use for example. Different claws 17, 40, 31 and/or 61, or a related variation, of different dimensions, including having different lengths, may be substituted according to snow conditions for example. When skiing on deep virgin snow, a skier may wish to use a longer claw 17, 40, 31 and/or 61 that is operable to penetrate deeper into the snow and/or a wider claw 17, 40, 31 and/or 61 that is operable to push rearward against snow with a wider sweep, for example. In contrast, a skier may wish to use a shorter and/or narrower claw 17, 40, 31 and/or 61 when skiing on hard-packed snow for example. While particular shapes of the claws 17, 40, 31 and 61 are shown in the Figures for ease of illustration, any suitable shape of claw 17, 40, 31 and/or 61 providing similar functionality is within the scope contemplated by the present invention.

A particular advantage of the embodiments described and illustrated herein is that ski-traction enhancement is obtained without unduly increasing the height above the ski body 22 of the binding 7 (FIGS. 1, 2, 5, 7 and 8), the binding 43 (FIGS. 9 and 12), the heel platform 14 (FIGS. 1, 2, 7 and 8), the front heel plate 54 (FIGS. 9 and 12) and the rear heel plate 55 (FIGS. 9 and 12). The low profile of the traction device 21 gives excellent lateral stability, minimizes rolling, and provides excellent control in the snowplow style of descent. Further variations of embodiments may further improve this particular advantage by lowering the overall profile height of the traction device 21, thereby minimizing the tendency for the ski 1 to roll and put rolling stress on a skier's ankle. By way of example only, a lower portion of the traction device 21 may be molded into the ski body 22 of the ski 1 to maintain a low profile. Additionally or alternatively, the sliding platform 3, 41, 24 and/or 42 and the rail 2, 4 and/or 50 may be partly or completely disposed at either side of the ski body 22, with the claws 17, 40, 31 and/or 61 being disposed at the front of the sliding platform 3, 41, 24 and/or 42 and the rail 2, 4 and/or 50, for example.

Thus, there is provided a ski for traveling on snow-covered ground, the ski comprising a longitudinal body defining a sole for contacting the snow-covered ground, the ski comprising: (a) a platform slidably coupled to the body for sliding longitudinally relative to the body; and (b) at least one gripping element coupled to the body and the platform for extending in a direction perpendicular to the sole in response to the platform being slid longitudinally relative to the body.

Method of Operation

After mounting a pair of the skis 1 according to a selected embodiment of the invention, a skier wishing to fully engage the traction device 21 on a given ski 1 (e.g. left or right) lifts their foot so that the ski 1 becomes unweighted and then moves their foot rearward with a jerking motion to cause the sliding platform 3, 41, 24 and/or 42 to slide rearward relative to the ski body 22 until the sliding platform 3, 41, 24 and/or 42 is moved fully rearward within the limit of its travel. Such rearward movement of the sliding platform 3, 41, 24 and/or 42 causes the claw(s) 17, 40, 31 and/or 61 to extend downwardly below the sole 23 of the ski body 22. The traction device 21 can be partly engaged by placing the sliding platform 3, 41, 24 and/or 42 to an intermediate position between the limits of its travel in which the claw(s) 17, 40, 31 and/or 61 extend downwardly below the sole 23 of the ski body 22 less than their maximum downward extension.

After fully or partly engaging the traction device 21, the skier lowers the ski 1 onto the snow-covered ground such that the claw(s) 17, 40, 31 and/or 61 penetrate into the snow for enhanced traction when the skier pushes their body forward against the force of traction between the ski 1 and the snow. The selected engagement of the traction device 21 is maintained by at least friction between the sliding platform 3, 41, 24 and/or 42 and the ski body 22, especially when the skier's weight is bearing down onto the sliding platform 3, 41, 24 and/or 42. Also, pushing forward against the force of traction between the traction-engaged ski 1 and the snow encourages the traction device 21 to remain engaged, even if the skier's weight is not bearing down onto the sliding platform 3, 41, 24 and/or 42 during the push-off phase.

The traction-enhanced push-off propels the skier forward on the skier's other ski 1 that is arranged for its traction device 21 to be in its disengaged state. Such other ski 1 glides along the snow with the skier, and allows the skier to bring the foot previously used for the push-off forward such that the sliding platform 3, 41, 24 and/or 42 slides forward relative to the ski body 22 so as to move the traction device 21 to its disengaged position. Thereafter, both skis 1 glide forward with their respective traction devices 21 in disengaged positions such that the claws 17, 40, 31 and/or 61 are positioned above the soles 23 to avoid inhibiting the forward gliding motion. The skier may at any time thereafter decide to perform a further push-off with either ski 1. When making the next push-off, the skier has the option of engaging the traction device 21 then lowering the ski 1 onto the snow as far forward as can be comfortably reached by the skier, such that during the subsequent push-off phase the skier is initially pulling him or herself forward while bearing no or minimal weight down onto the ski 1. Such traction-enhanced pulling is not possible with conventional skis absent sufficient weight bearing down onto the conventional ski.

The present invention makes the ascent of steep slopes possible without side-stepping or herring-boning. By engaging the traction device 21 with each step, steep slopes can be climbed in a fashion close to natural walking because engaging the traction device 21 provides excellent positive traction even when the skis 1 are both facing directly uphill. While it is not necessary to manually lock the traction device 21 in its engaged position because the skier can readily engage the traction device 21 with every step, some skiers may wish to lock the traction device 21 in an engaged position for long ascents.

The present invention makes a skate-boarding style of propulsion possible, even on level ground, by permitting the skier to perform repeated push-offs using one ski 1, with its traction device 21 engaged, and glide the other ski 1 while its traction device 21 is disengaged. The enhanced-traction skate-boarding style of propulsion is advantageously more forceful, faster and less tiring than the conventional "marathon skate" style of cross-country skiing in which one ski glides forward while skating outwards to the side repeatedly with the other ski. Also, the traction-enhanced skateboard effect cannot be achieved with nearly as much kick force using traditional waxed or waxless skis when the skis are positioned parallel to each other in the forward direction of travel.

The present invention is advantageously compatible with the classical, skate, free-style, Nordic, mountaineering and other styles of cross-country skis, touring skis, and other types of skis. The present invention is advantageously compatible with cross-country and other forms of skiing.

Retro-Fitting Kit

The traction device 21 in accordance with any embodiment of the invention is suitable for installation on conventional skis, such as cross-country skis, touring skis or other types of skis. In particular, the traction device 21 can be retro-fitted to previously manufactured skis. A retro-fitting kit in accordance with embodiments of the invention typically includes the components described and illustrated herein other than the ski body 22. Some kits do not include a binding, while other kits include the binding 7 and/or 43.

Typically, the kit includes assembly instructions for installing the traction device 21 to a pair of previously manufactured skis, including installing the rails 2, 4 and/or 50; the sliding platforms 3, 41, 24 and/or 42; the claws 17, 40, 31 and/or 61; and other related components for example. Retro-fitting kits in accordance with the third embodiment of the invention preferably include, in part, instructions corresponding to the method of assembly provided herein above.

Thus, there is provided a ski-traction kit for retrofitting a ski, the ski being operable to travel on snow-covered ground and comprising a longitudinal body defining a sole for contacting the snow-covered ground, the kit comprising: (a) a platform dimensioned for being coupled to the body such that the platform becomes longitudinally slidable relative to the body; and (b) at least one gripping element dimensioned for being coupled to the body and the platform such that the at least one gripping element becomes extendable in a direction perpendicular to the sole in response to the platform being slid longitudinally relative to the body.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. A ski for traveling on snow-covered ground, the ski comprising a longitudinal body defining a sole for contacting the snow-covered ground, the ski comprising:

(a) a platform slidably coupled to the body for sliding longitudinally relative to the body; and (b) at least one gripping element coupled to the platform and slidably and rotatably coupled to the body for extending in a direction perpendicular to the sole in response to the platform being slid longitudinally relative to the body.

2. The ski of claim 1 wherein the at least one gripping element is operable to extend in a first perpendicular direction perpendicular to the sole in response to the platform sliding in a first longitudinal direction relative to the body, and is operable to retract in a second perpendicular direction opposite the first perpendicular direction in response to the platform sliding in a second longitudinal direction opposite the first longitudinal direction.

3. A ski for traveling on snow-covered ground, the ski comprising a longitudinal body defining a sole for contacting the snow-covered ground, the ski comprising:

(a) a platform slidably coupled to the body for sliding longitudinally relative to the body; and (b) at least one gripping element coupled to the platform and slidably and rotatably coupled to the body for extending in a direction perpendicular to the sole in response to the platform being slid longitudinally relative to the body, wherein the at least one gripping element is operable to extend in a first perpendicular direction perpendicular to the sole in response to the platform sliding in a first longitudinal direction relative to the body, the at least one gripping element is operable to retract in a second perpendicular direction opposite the first perpendicular direction in response to the platform sliding in a second longitudinal direction opposite the first longitudinal direction, the body defines a forward direction toward a front section of the ski, the body defines a downward direction through the body perpendicularly toward the sole, the first perpendicular direction is the downward direction, the first longitudinal direction is a rearward direction opposite the forward direction, the second perpendicular direction is an upward direction opposite the downward direction, and the second longitudinal direction is the forward direction.

4. The ski of claim 3 wherein the at least one gripping element is dimensioned for extending beyond the body in the downward direction so as to penetrate into snow of the snow-covered ground when the platform is slid in the rearward direction sufficiently relative to the body.

5. The ski of claim 3 wherein the at least one gripping element is dimensioned for not extending beyond the body in the downward direction when the platform is slid in the forward direction sufficiently relative to the body.

6. The ski of claim 1 wherein the at least one gripping element is rotatably coupled to the platform.

7. The ski of claim 1 wherein the at least one gripping element is selected from the group consisting of: at least one paisley-shaped claw, at least one rectangular U-shaped claw, at least one angled U-shaped claw, and at least one eye-rod claw.

8. The ski of claim 1 further comprising a bumper attached to the body for limiting the sliding travel of the platform.

9. The ski of claim 1 wherein the body defines a downward direction perpendicularly toward the sole from an upper side of the body opposite the sole, the platform is coupled to the body at the upper side, and wherein the platform is operable to resist sliding relative to the body in response to receiving pressure in the downward direction toward the body.

10. The ski of claim 9 wherein the platform comprises a binding for receiving a ski boot, the platform being operable to receive the pressure from the ski boot.

11. The ski of claim 1 wherein the at least one gripping element comprises first and second elements disposed on opposing sides of the body.

12. The ski of claim 1 further comprising a locking mechanism for locking the platform so as to prevent longitudinal sliding of the platform when the locking mechanism is engaged.

13. The ski of claim 12 wherein the locking mechanism is operable to lock the platform in a locked position selected from the group consisting of: a forward position, one or more intermediate positions and a rearward position.

14. A ski-traction kit for retrofitting a ski, the ski being operable to travel on snow-covered ground and comprising a longitudinal body defining a sole for contacting the snow-covered ground, the kit comprising:

(a) a platform dimensioned for being coupled to the body such that the platform becomes longitudinally slidable relative to the body; and (b) at least one gripping element dimensioned for being coupled to the platform and slidably and rotatably coupled to the body such that the at least one gripping element becomes extendable in a direction perpendicular to the sole in response to the platform being slid longitudinally relative to the body.

15. The kit of claim 14 further comprising instructions for coupling the platform to the body and for coupling the at least one gripping element to the body and the platform.

* * * * *